US007030866B2

(12) United States Patent
Chen

(10) Patent No.: US 7,030,866 B2
(45) Date of Patent: Apr. 18, 2006

(54) PIXEL STRUCTURE OF A DISPLAY

(75) Inventor: Li-Yi Chen, Nantou (TW)

(73) Assignee: CHI MEI Optoelectronics Corporation, Tainan (TW)

( * ) Notice: Subject to any disclaimer, the term of this patent is extended or adjusted under 35 U.S.C. 154(b) by 340 days.

(21) Appl. No.: 10/397,486

(22) Filed: Mar. 26, 2003

(65) Prior Publication Data

US 2003/0184510 A1 Oct. 2, 2003

(30) Foreign Application Priority Data

Mar. 29, 2002 (TW) ..... 91106429 A

(51) Int. Cl.
*G09G 3/10* (2006.01)

(52) U.S. Cl. ..... 345/204; 345/90; 345/92; 345/98; 345/205; 345/690

(58) Field of Classification Search ..... 345/36, 345/46, 48, 50, 76, 87, 91, 92, 98, 204, 205, 345/690, 90; 315/163.3, 163.1; 257/290
See application file for complete search history.

(56) References Cited

U.S. PATENT DOCUMENTS 5,349,366 A * 9/1994 Yamazaki et al. ..... 345/92
5,744,837 A * 4/1998 Kamiura et al. ..... 257/355
5,952,991 A * 9/1999 Akiyama ..... 345/98
6,169,532 B1 * 1/2001 Sumi et al. ..... 345/98
6,246,180 B1 * 6/2001 Nishigaki ..... 315/169.3
6,410,900 B1 * 6/2002 Okamoto ..... 250/208.1
2002/0089291 A1 * 7/2002 Kaneko et al. ..... 315/169.3
2002/0114025 A1 * 8/2002 Raynor et al. ..... 358/513
2002/0167472 A1 * 11/2002 Jinno ..... 345/76

* cited by examiner

*Primary Examiner*—Amr A. Awad
*Assistant Examiner*—Vincent E. Kovalick
(74) *Attorney, Agent, or Firm*—Merchant & Gould P.C.

(57) ABSTRACT

A pixel structure of a display. A scanning electrode is provided to scan signals and a data electrode is used to provide data signals. Also, a first switch transistor comprises a first terminal for receiving the scanning signals and a second terminal for receiving the data signals, in which the first switch transistor outputs a switch signal in accordance with the scanning signal and the data signal. A display unit is coupled to the first switch transistor and outputs image data in accordance with the switch signal. A second switch transistor is coupled to the first switch transistor in which the second switch transistor becomes conductive according to the switch signal and a blanking signal provided by the exterior power so as to modify the image data.

7 Claims, 8 Drawing Sheets

PIXEL STRUCTURE OF A DISPLAY

BACKGROUND OF THE INVENTION

1. Field of the Invention

The present invention relates to a pixel structure of a display and, more particularly, to a pixel structure having a metal-insulation-metal (MIM) transistor to provide a blanking effect.

2. Description of the Related Art

The manufacture and use of thin film transistor liquid crystal display (TFT-LCD) is well known in the art. FIG. 1 is an equivalent circuit diagram of a conventional TFT-LCD. On an LCD panel 1, data electrodes in a sequence of D1, D2, D3 and Dy and scanning electrodes in a sequence of G1, G2 and Gx are arranged in a crisscross pattern to control display cells arranged in a matrix form. For example, the data electrode D1 and the scanning electrode G1 are employed to control the display cell 100. The display cell 100, the same as other display cells, comprises a thin film transistor 101, a storage capacitor 103 and an LCD capacitor 102, in which the LCD capacitor 102 comprises a display electrode and a common electrode. The thin film transistor 101 has a gate electrode electrically connected to the scanning electrode G1, and a drain electrode electrically connected to the data electrode D1, wherein scanning signals on the scanning electrode G1 control the on/off state of the thin film transistor 101 to write video signals on the data electrode D1 into the display cell 100. Also, according to scanning control data, a scanning driver 3 delivers scanning signals on the scanning electrodes in a sequence of G1, G2 and Gx to simultaneously turn on thin film transistors arranged on only one row of display cells and turn off other thin film transistors arranged on other (x−1) rows of display cells. When the thin film transistors arranged on one row of display cells are turned off, a data driver 2 delivers video signals (gray scale) corresponding to predetermined image data to y display cells arranged on the same row through the data electrodes in a sequence of D1, D2, D3 and Dy. After the scanning driver 3 scans x rows of gate electrodes once, a single frame of display is completed. Thereafter, by repeated scanning of the scanning electrodes to deliver video signals, predetermined images are displayed.

The same scanning method is also applied to an organic light emitting diode (OLED) in which circuit structure is similar to that of the TFT-LCD. FIG. 2 is an equivalent circuit diagram of a conventional OLED. On an OLED panel 11, data electrodes in a sequence of D1, D2, D3 and Dy and scanning electrodes in a sequence of G1, G2 and Gx are arranged in a crisscross pattern to control display cells arranged in a matrix form. For example, the data electrode D1 and the scanning electrode G1 are employed to control the display cell 200. The display cell 200, the same as other display cells, comprises two thin film transistors 201 and 202, an OLED unit 203 and a storage capacitor 204. The thin film transistor 201 has a gate electrode electrically connected to the scanning electrode G1, and a drain electrode electrically connected to the data electrode D1, wherein scanning signals on the scanning electrode G1 control the on/off state of the thin film transistor 201 to write video signals on the data electrode D1 into the display cell 200. Also, according to scanning control data, a scan driver 13 delivers scanning signals on the scanning electrodes in a sequence of G1, G2 and Gx in sequence to simultaneously turn on the thin film transistors arranged on only one row of display cells and turn off other thin film transistors arranged on other (x−1) rows of display cells. When the thin film transistors arranged on one row of display cells are turned on, a data driver 12 delivers video signals (gray scale) corresponding to predetermined image data to y display cells arranged on the same row through the data electrodes in a sequence of D1, D2, D3 and Dy. After the scanning driver 13 scans x rows of scanning electrodes once, a single frame of display is completed. Therefore, by repeated scanning of the scanning electrodes to deliver video signals, predetermined images are displayed.

FIG. 3 shows a function of illumination and time according to the above-described display cells, in which the illumination is based on the condition of the LCD capacitor 102 or the OLED unit 203. As well known in the art, the image retention characteristic of the human eye allows successive frames from the display cell to be seen. This characteristic is similar to image integration from the human eye, and a function of illumination and time with regards to the human eye is shown in FIG. 4 in which moving images look vague.

In order to solve the above-described problem, one current approach is to blank the illumination in predetermined portions as shown by oblique lines in FIG. 5, resulting in the desired interaction between illumination and time (as shown in FIG. 3) acting on the human eye. However, this only adjusts brightness towards vision without solving the above-described problem generated in darkness towards vision.

Also, control of the blanking time is very important. If the blanking time is too short, vague images are still generated. If the blanking time is too long, the illumination of the display cell darkens to decrease display performance. However, the blanking time is commonly fixed within a specific time of the display period, and is therefore unable to immediately adjust the blanking time in accordance with the practical signal status. In order to properly control the blanking time, another current approach is to add extra driving devices or change scanning frequency. Circuit components are consumed to modify the circuit structure.

SUMMARY OF THE INVENTION

The present invention provides a pixel structure with a metal-insulation-metal (MIM) transistor to solve the above-described problems. In comparison with the MIM transistor conventionally employed for regulating the capacitor, the present invention uses the MIM transistor as the source of blanking signals to achieve the blanking effect without adding other extra devices. Also, by modifying the voltage level of the blanking signal, the blanking time is adjusted to achieve desired display performance.

Accordingly, it is a principal object of the invention to provide a pixel structure of a display in which a scanning electrode is provided to scan signals and a data electrode is used to provide data signals. Also, a first switch transistor comprises a first terminal for receiving the scanning signals and a second terminal for receiving the data signals, in which the first switch transistor outputs a switch signal in accordance with the scanning signal and the data signal. A display unit is coupled to the first switch transistor and outputs image data in accordance with the switch signal. A second switch transistor is coupled to the first switch transistor in which the second switch transistor becomes conductive according to the switch signal and a blanking signal provided by the exterior power so as to modify the image data.

It is another object of the invention to provide a MIM transistor as the second switch transistor.

Yet another object of the invention is to provide the second switch transistor with a storage capacitor coupled to the first switch transistor to fix the bias of the display.

It is a further object of the invention to provide the second switch transistor with a first diode that comprises a first cathode terminal coupled to the first switch transistor and a first anode terminal for receiving the blanking signal.

Still another object of the invention is to provide the second switch transistor with a second diode that comprises a second anode coupled to the first switch transistor and a second cathode terminal for receiving the blanking signal.

These and other objects of the present invention will become readily apparent upon further review of the following specification and drawings.

DESCRIPTION OF THE DRAWINGS

Similar reference characters denote corresponding features consistently throughout the attached drawings.

DETAILED DESCRIPTION OF THE INVENTION

The present invention provides a pixel structure applied to an LCD device as hereinafter described in the first embodiment, or to an OLED device as hereinafter described in the second embodiment.

[First Embodiment]

Figure 1:
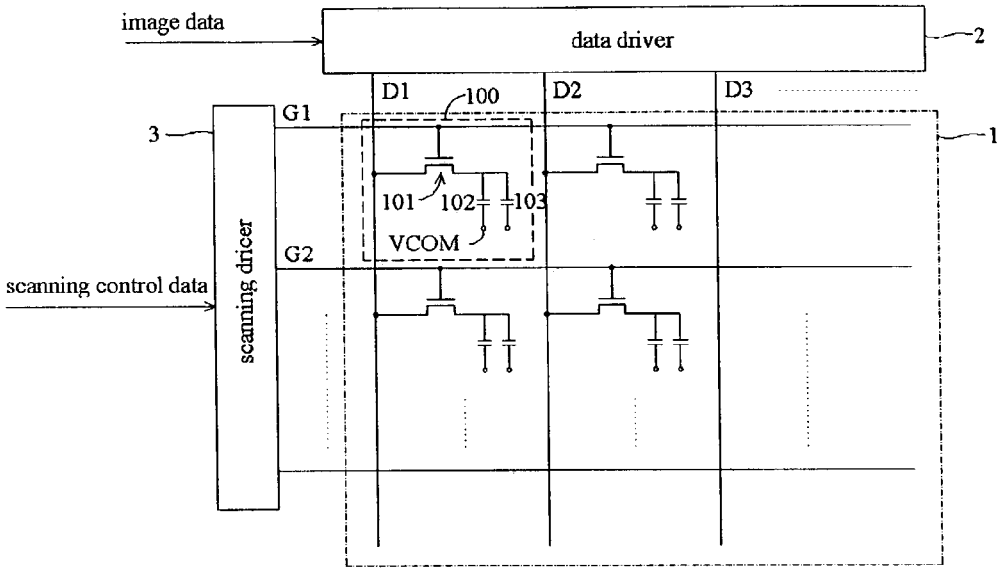
FIG. 1 ( PRIOR ART )
FIG. 1 is an equivalent circuit diagram of a conventional TFT-LCD.
Figure 2:
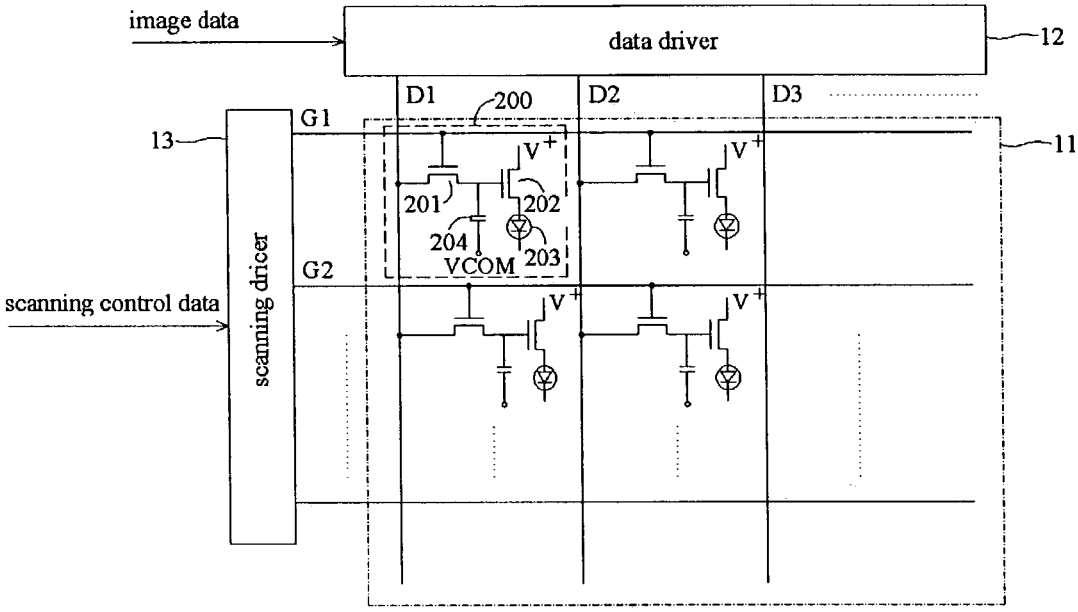
FIG. 2 ( PRIOR ART )
FIG. 2 is an equivalent circuit diagram of a conventional OLED.
Figure 3:
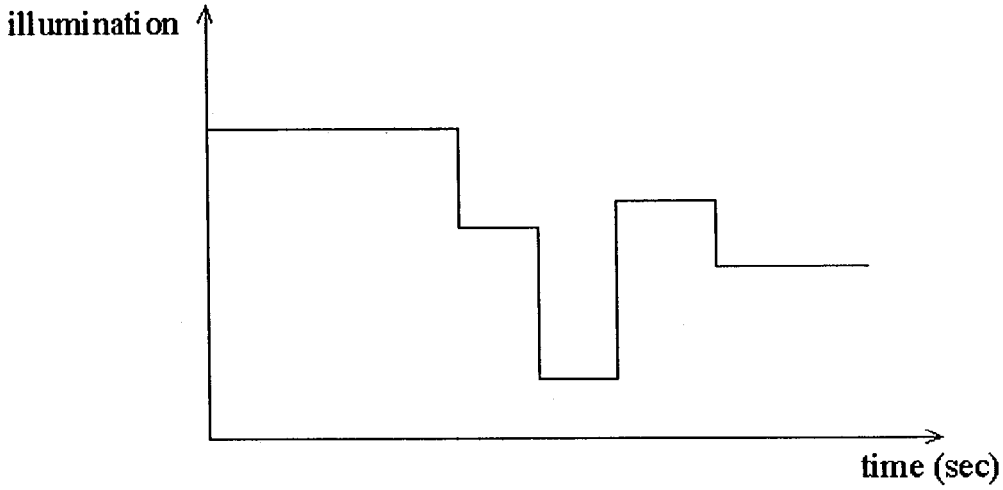
FIG. 3 ( PRIOR ART )
FIG. 3 shows a function of illumination and time according to the above-described display cells.
Figure 4:
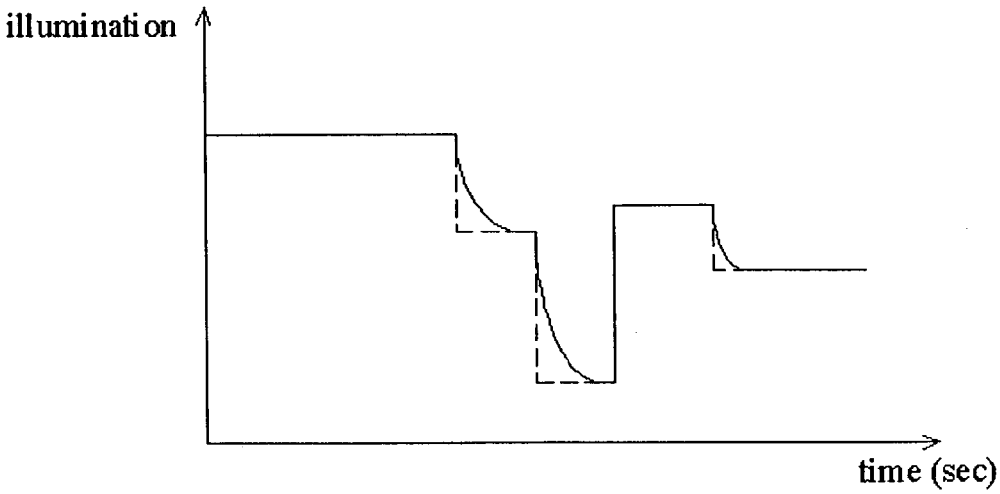
FIG. 4 ( PRIOR ART )
FIG. 4 shows a function of illumination and time according to the human eye.
Figure 5:
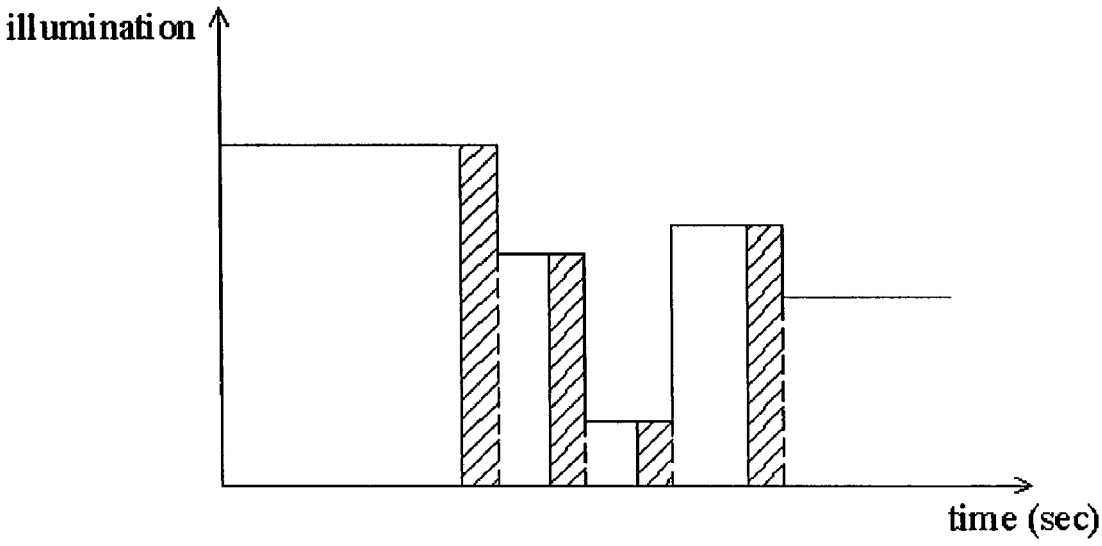
FIG. 5 ( PRIOR ART )
FIG. 5 shows function of illumination and time with blanking effect.
Figure 6:
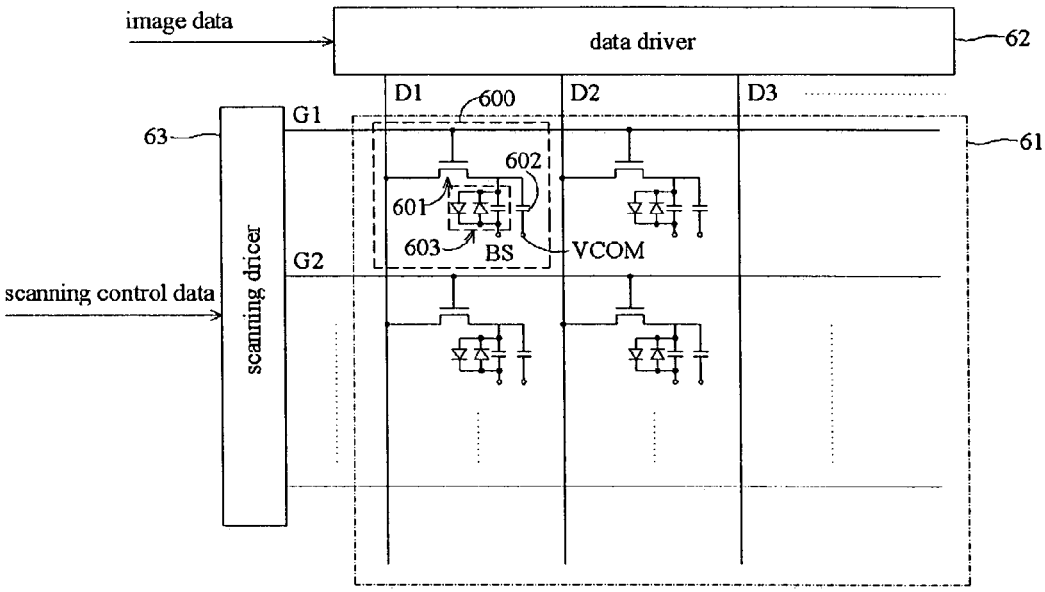
FIG. 6 is an equivalent circuit diagram of an LCD according to the first embodiment of the present invention.
Figure 7:
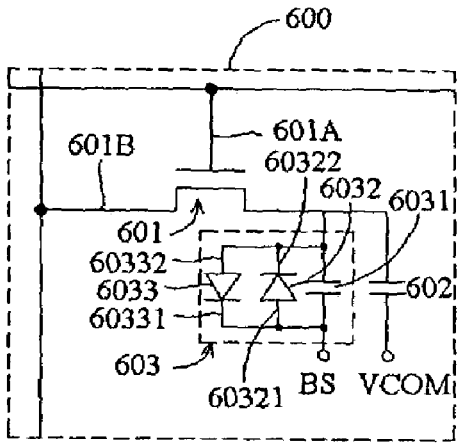
FIG. 7 is an equivalent circuit diagram of a display cell shown in FIG. 6.

FIG. 6 is an equivalent circuit diagram of an LCD according to the first embodiment of the present invention. FIG. 7 is an equivalent circuit diagram of a display cell shown in FIG. 6.

On an LCD panel, data electrodes in a sequence of D1, D2, D3 and Dy and scanning electrodes in a sequence of G1, G2 and Gx are arranged in a crisscross pattern to control display cells arranged in a matrix form. For example, the data electrode D1 and the scanning electrode G1 are employed to control the display cell 600. Also, a scanning driver 63 delivers scanning control data according to scanning signals provided by the scanning electrode G1, and a data driver 62 delivers data control signals according to data signals provided by the data electrode D1. Furthermore, the display cell 600 comprises a first switch transistor 601 (preferably a TFT device), an LCD unit 602 and a second switch transistor 603.

The first switch transistor 601 comprises a first input terminal 601A for receiving the scanning signals and a second input terminal 601B for receiving the data signals so as to output a switch signal. In accordance with the switch signal, the LCD unit 602 that is coupled to the first switch transistor 601 outputs image data. Therefore, using the scanning signals on the scanning electrode G1 to control the on/off state of the first switch transistor 601, the image data on the data electrode D1 can be written into the display cell 600. In accordance with scanning control data, the scanning driver 63 delivers scanning signals on the scanning electrodes in a sequence of G1, G2 and Gx to simultaneously turn on the first switch transistors arranged on only one row of display cells and turn off other switch transistors arranged on other (x−1) rows of display cells. When the first switch transistors arranged on one row of display cells are turned on, the data driver 62 delivers video signals (gray scale) corresponding to predetermined image data to y display cells arranged on the same row through the data electrodes in a sequence of D1, D2, D3 and Dy. After the scanning driver 63 scans x rows of scanning electrodes once, a single frame of display is completed. Therefore, by repeated scanning of the scanning electrodes to deliver video signals, predetermined images are displayed.

In addition, the second switch transistor 603 is a metal-insulation-metal (MIM) transistor and is coupled to the first switch transistor 601. Based on the above-described switch signal and a blanking signal (BS) provided by exterior, the second switch transistor 603 becomes conductive to adjust the above-described image data. The second switch transistor 603 comprises a storage capacitor 6031, a first diode 6032 and a second diode 6033. The storage capacitor 6031 is coupled to the first switch transistor 601 to regulate the bias of the LCD unit 602. The first diode 6032 comprises a first cathode terminal 60322 coupled to the first switch transistor 601, and a first anode terminal 60321 for receiving the blanking signal (BS). The second diode 6033 comprises a second anode terminal 60332 coupled to the first switch transistor 601, and a second cathode terminal 60331 for receiving the blanking signal (BS).

Using the blanking signal (BS) to vary the conductive state of the diodes in the second switch transistor 602, the charges within the LCD unit 602 can be changed to achieve a desired display performance. For example, in order to decrease the illumination of the LCD unit 602, the voltage level of blanking signal (BS) can be modulated to make the second diode 6033 conductive to decrease the accumulated charges within the LCD unit 602. Similarly, in order to increase the illumination of the LCD unit 602, the voltage level of blanking signal (BS) can be modulated to make the first diode 6032 conductive to increase the accumulated charges within the LCD unit 602. However, in practical operation, when the diodes of the second switch transistor 603 are not conductive, the blanking signal (BS) can still change the state of the LCD unit 602 because a charge coupling effect is generated on the capacitor of the second switch transistor 603. This provides effective blanking function to promote LCD performance.

[Second Embodiment]

Figure 8:
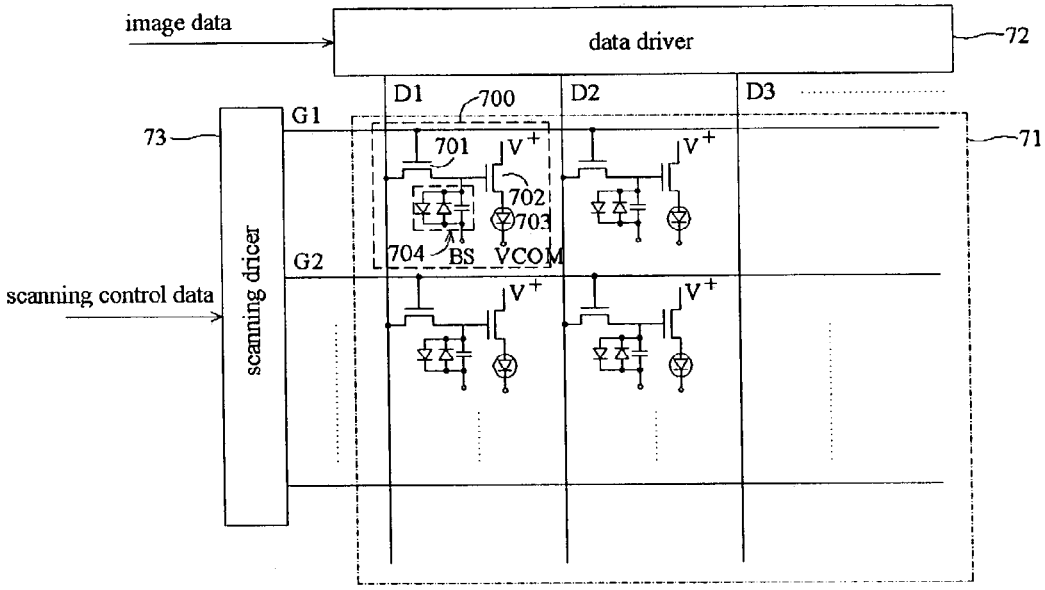
FIG. 8 is an equivalent circuit diagram of an OLED according to the second embodiment of the present invention.
Figure 9:
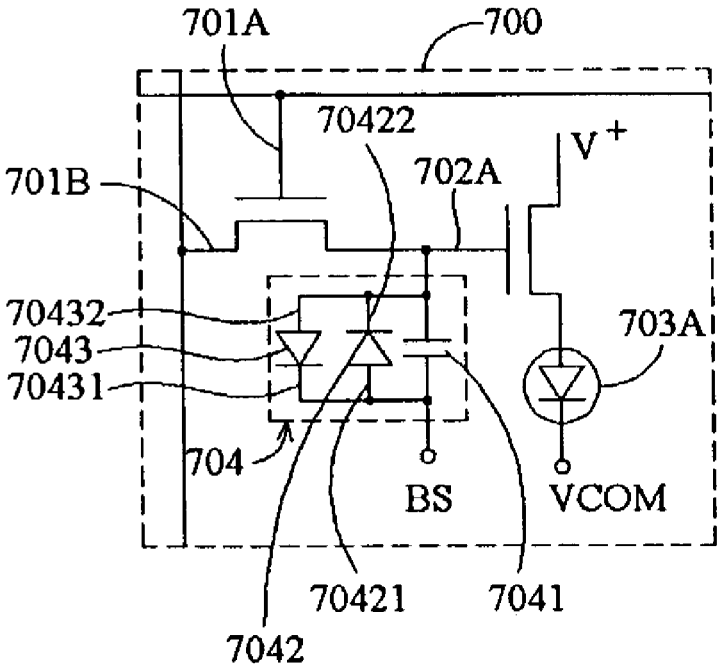
FIG. 9 is an equivalent circuit diagram of a display cell shown in FIG. 8.

FIG. 8 is an equivalent circuit diagram of an OLED according to the second embodiment of the present invention. FIG. 9 is an equivalent circuit diagram of a display cell shown in FIG. 8.

On an OLCD panel, data electrodes in a sequence of D1, D2, D3 and Dy and scanning electrodes in a sequence of G1, G2 and Gx are arranged in a crisscross pattern to control display cells arranged in a matrix form. For example, the data electrode D1 and the scanning electrode G1 are employed to control the display cell 700. Also, a scanning driver 73 delivers scanning control data according to scanning signals provided by the scanning electrode G1, and a data driver 72 delivers data control signals according to data signals provided by the data electrode D1. Furthermore, the display cell 700 comprises a first switch transistor 701, a second switch transistor 704, a third switch transistor 702 and an OLED unit 703.

The first switch transistor 701, preferably a TFT device, comprises a first input terminal 701A for receiving the scanning signals and a second input terminal 701B for receiving the data signals so as to output a switch signal. The third switch transistor 702, preferably a TFT device, comprises a gate electrode 702A coupled to the first switch transistor 701, and a drain electrode coupled to an anode terminal 703A of the OLED unit 703.

When the third transistor 702 becomes conductive under the control of the switch signal, the OLED unit 703 can output image data in accordance with the bias provided by the external power. Also, using the scanning signal on the scanning electrode G1 to control the on/off state of the first switch transistor 701, the image data on the data electrode D1 can be written into the display cell 700. Based on scanning control data, the scanning driver 73 delivers scanning signals on the scanning electrodes in a sequence of G1, G2 and Gx to simultaneously turn on the first switch transistors arranged on only one row of display cells and turn off other switch transistors arranged on other (x−1) rows of display cells. When the first switch transistors arranged on one row of display cells are turned on, the data driver 72 delivers video signals (gray scale) corresponding to predetermined image data to y display cells arranged on the same row through the data electrodes in a sequence of D1, D2, D3 and Dy. After the scanning driver 73 scans x rows of scanning electrodes once, a single frame of display is completed. Therefore, by repeated scanning of the scanning electrodes to deliver video signals, predetermined images are displayed.

In addition, the second switch transistor 704 is a metal-insulation-metal (MIM) transistor and is coupled to the first switch transistor 701. Based on the above-described switch signal and a blanking signal (BS) provided by exterior, the second switch transistor 704 becomes conductive to modify the above-described image data. The second switch transistor 704 comprises a storage capacitor 7041, a first diode 7042 and a second diode 7043. The storage capacitor 7041 is coupled to the first switch transistor 701 to regulate the bias of the third switch transistor 702. The first diode 7042 comprises a first cathode terminal 70422 coupled to the first switch transistor 701, and a first anode terminal 70421 for receiving the blanking signal (BS). The second diode 7043 comprises a second anode terminal 70432 coupled to the first switch transistor 701, and a second cathode terminal 70431 for receiving the blanking signal (BS).

Using the blanking signal (BS) to vary the conductive state of the diodes in the second switch transistor 704, the charges within the OLED unit 703 can be changed to achieve a desired display performance. For example, in order to decrease the illumination of the OLED unit 703, the voltage level of blanking signal (BS) can be modulated to make the second diode 7043 conductive to decrease the bias of the gate electrode 702A of the third switch transistor 702. This gradually turns off the third switch transistor 702 to decrease the current through the OLED unit 703, resulting in decreased illumination. Similarly, in order to increase the illumination of the OLED unit 703, the voltage level of blanking signal (BS) can be modulated to make the first diode 7042 conductive to increase the bias of the gate electrode 702A of the third switch transistor 702. This increases the current through the OLED unit 703, resulting in increased illumination. However, in practical operation, when the diodes of the second switch transistor 704 are not conductive, the blanking signal (BS) still can change the state of the OLED unit 703 because a charge coupling effect is generated on the capacitor of the second switch transistor 704. This provides effective blanking function to promote OLED performance.

It is to be understood that the present invention is not limited to the embodiments described above, but encompasses any and all embodiments within the scope of the following claims.

What is claimed is:

1. A pixel structure of a display, comprising:

a scanning electrode for providing scanning signals;

a data electrode for providing data signals;

a first switch transistor which comprises a first terminal for receiving the scanning signals and a second terminal for receiving the data signals, wherein the first switch transistor outputs a switch signal in accordance with the scanning signal and the data signal, and first switch transistor is a thin film transistor;

a display unit coupled to the first switch transistor, wherein the display unit outputs image data in accordance with the switch signal; and a second switch transistor coupled to the first switch transistor, wherein the second switch transistor becomes conductive according to the switch signal and a blanking signal provided by the exterior power so as to modify the image data, the second switch transistor is a metal-insulation-metal transistor, and the second switch transistor includes:

a storage capacitor coupled to the first switch transistor to regulate the bias of the display unit;

a first diode which comprises a first cathode terminal coupled to the first switch transistor and a first anode terminal for receiving the blanking signal; and a second diode which comprises a second anode terminal coupled to the first switch transistor and a second cathode terminal for receiving the blanking signal.

2. The pixel structure of a display according to claim 1, wherein the display unit is a liquid crystal display (LCD) unit.

3. The pixel structure of a display according to claim 1, wherein the display unit comprises:

an organic light emitting diode (OLED) unit; and a third switch transistor which comprises a gate electrode coupled to the first switch transistor and a drain electrode coupled to an anode terminal of the OLED unit.

4. The pixel structure of a display according to claim 3, wherein the third switch transistor is a thin film transistor.

5. A pixel structure of a display, comprising:

a scanning electrode for providing a scanning signal;

a data electrode for providing a data signal;

a switch transistor having a gate terminal for connecting to the scanning signal, a source terminal for connecting the data signal, and a drain terminal for generating a switch signal according to the scanning signal and the data signal;

a display unit coupled to said switch transistor, wherein said display unit outputs an pixel image according to the switch signal; and a blanking means comprising:

a capacitor coupled to the drain terminal of said switch transistor;

a first diode having a first cathode terminal coupled to the drain terminal of said switch transistor and a first anode terminal for connecting to an external blanking signal; and a second diode having a second anode terminal coupled to said switch transistor and a second cathode terminal for connecting to the blanking signal.

6. The pixel structure of a display according to claim 5, wherein said display unit is a liquid crystal display (LCD) unit.

7. The pixel structure of a display according to claim 5, wherein said display unit comprises:

an organic light emitting diode (OLED) unit; and a second switch transistor having a gate terminal coupled to the drain terminal of said first switch transistor and a drain terminal coupled to an anode terminal of said OLED unit.

* * * * *